US007677532B2

(12) United States Patent
Overå et al.

(10) Patent No.: US 7,677,532 B2
(45) Date of Patent: Mar. 16, 2010

(54) SYSTEM TO GUIDE A WIRE, CHAIN OR CABLE ONBOARD A VESSEL

(75) Inventors: Arild Overå, Hjørungavåg (NO); Per Huse, Ålesund (NO)

(73) Assignee: Rolls-Royce Marine AS, Braatvåg (NO)

( * ) Notice: Subject to any disclaimer, the term of this patent is extended or adjusted under 35 U.S.C. 154(b) by 0 days.

(21) Appl. No.: 11/990,609

(22) PCT Filed: Aug. 17, 2006

(86) PCT No.: PCT/NO2006/000295

§ 371 (c)(1),
(2), (4) Date: Nov. 7, 2008

(87) PCT Pub. No.: WO2007/021195

PCT Pub. Date: Feb. 22, 2007

(65) Prior Publication Data

US 2009/0065751 A1 Mar. 12, 2009

(30) Foreign Application Priority Data

Aug. 18, 2005 (NO) ..... 20053871

(51) Int. Cl.
*B66D 1/00* (2006.01)
*B25B 25/00* (2006.01)

(52) U.S. Cl. ..... 254/277; 254/394; 114/199

(58) Field of Classification Search ..... 242/157.1; 254/277, 335–338, 394, 395; 114/199, 218
See application file for complete search history.

(56) References Cited

U.S. PATENT DOCUMENTS

| | | | | |
|---|---|---|---|---|
| 3,588,051 | A | 6/1971 | Leeming | |
| 3,771,488 | A * | 11/1973 | Ecke | 114/218 |
| 4,278,041 | A | 7/1981 | Williams | |
| 4,423,697 | A | 1/1984 | Royset | |
| 4,603,649 | A | 8/1986 | Hystad | |
| 4,760,992 | A * | 8/1988 | Peppel et al. | 254/277 |
| 4,846,446 | A * | 7/1989 | Peppel et al. | 254/277 |
| 6,044,787 | A | 4/2000 | Elmbo | |
| 7,367,278 | B2 * | 5/2008 | Tande et al. | 114/199 |
| 2007/0069540 | A1 * | 3/2007 | Tande et al. | 294/132 |

FOREIGN PATENT DOCUMENTS

| | | | |
|---|---|---|---|
| DE | 8218675 | U1 | 10/1982 |
| WO | WO 2005/070754 | A1 | 8/2005 |

OTHER PUBLICATIONS

Int'l Search Report, Dec. 20, 2006.

* cited by examiner

*Primary Examiner*—Evan H Langdon
(74) *Attorney, Agent, or Firm*—Abelman, Frayne & Schwab

(57) ABSTRACT

A system is described for handling a wire, a chain, a cable, etc. (12) onboard a vessel, comprising a number of winches (10) to pull in and let out said wire, chain, etc. (12), and also a number of tow pins (14) and shark jaws (16), mounted in an area at the stern of the vessel, and which is arranged to guide and/or to hold said wire, chain, etc. (12) that runs from or to said winches (10). The system further comprises at least one centering device (18) arranged between said tow pins (14) and shark jaws (16) and winches (10), preferably adjoining said tow pins (14) and shark jaws (16), where the centering device (18) comprises at least two guiding plates (20) that can be raised and lowered and which are arranged to guide and possibly to hold said wire, chain, etc. (12).

11 Claims, 3 Drawing Sheets

SYSTEM TO GUIDE A WIRE, CHAIN OR CABLE ONBOARD A VESSEL

The present invention relates to a system for handling a wire, a chain, a cable, etc., onboard a vessel, comprising a number of winches for pulling in and letting out said wire, chain, etc., and also a number of tow pins and shark jaws, mounted in an area at the stern of the vessel, and which are arranged to lead and/or to hold said wire, chain, etc. that runs to or from said winches.

On tug boats and other boats/ships that are particularly used in the offshore industry, so called anchor handling boats, it is common to mount appliances at the stern of the boat, where the appliances are used for the handling of cables, such as chain, wire, hawser etc. Among other things, a tow pin is used and is normally used in connection with arrangements to hold and secure the cable. During work on anchor handling boats where large winches are used, arrangements are normally installed to hold or to secure chain and wire/hawser during connection and disconnection. This arrangement is called shark jaw and is normally mounted aft on all such anchor handling boats. These boats are now used at large ocean depths in connection with, among other things, the petroleum industry, and it has been found that previously known solutions and equipment can not meet the requirements for load and safety that are required. In that the wires and chains that are used today are of considerably larger dimensions than those used some years ago, the demand for what this equipment shall be able to withstand has increased considerably.

Furthermore, such arrangements can be used as an active tool during anchor handling in anchoring of offshore installations and also on tugboats and at other tugging operations.

Work in connection with moving, locking, securing and clamping components on a vessel encompassing wire, rope, fibre hawser, chain, which are used during all anchor handling and/or tugboat operations, is called a "tow". After a "tow" is in position between tow pins, by sideways movement, it is held initially by tugger winches or lies lose on deck. This leads to the "tow" normally lying outside the gripping area of the shark jaw and results in personnel having to enter an unsecured deck to shackle a helping wire or, in another way, move the "tow" sideways so that the shark jaw gets hold of it when this is driven. Then, the "tow" can be secured in the shark jaw for connection to a wire on the main winch.

After the "tow" is secured in the shark jaw so that it does not run overboard, it is pulled somewhat back between the winch and the shark jaw to get a slack in the "tow" for easy out-shackling/replacing of tow components. In out-shackling, it often occurs that the "tow" rotates due to the wire having been heavily loaded.

This rotation has led to serious accidents because heavy steel components consisting of shackles etc. are thrown around on deck with great force and can hit personnel.

The object of the present invention is to provide a system as a tool for moving, locking, securing, clamping components on a vessel encompassing wire, rope, fibre hawser, chain, that are used during all anchor handling and/or tugging operations. Furthermore, it is an object to provide a system which, to a large degree, secures the working conditions for those that work on the deck of a vessel.

A centring device that is part of the system according to the invention can clamp and secure against rotation a wire, a chain, etc. of, for example, 50 to 165 mm diameter without inserting jaws. To clamp a wire, something which is used less often as most wire lengths have some chain links at each end, the centring device can at first be driven up from the deck and the jaws/inserts for wire can be mounted. Thereafter, the centring device is operated until the wire is clamped.

The centring device according to the invention can, for example, be composed of two thick steel plates in a trapezoidal form that are driven out from a chest/box on deck. Each steel plate or arm can be moved individually by its own hydraulic cylinder, with each cylinder having its own function button on the bridge. Clearance of the chest/box is small, but seawater can enter into the chest around the edges of the arms. Therefore, it is preferred that the chest/box can be drained through the bottom. The chest/box can have a lid below the deck for servicing and maintenance. The system according to the invention is preferably level with the deck without protruding edges.

The above mentioned objects can be achieved with a system according to the characteristic of the independent claim 1, in that the system according to the invention comprises at least one centring device arranged between said tow pins and shark jaws and winches, preferably adjoining said tow pins and shark jaws, where the centring device comprises at least two guiding plates that can be raised and lowered, and which are arranged to guide and possibly hold said wire, chain, etc.

Preferred alternative embodiments are characterised by the dependent claims 2-10.

Each of the guiding plates of the centring device is preferably mounted so that they can rotate about their separate mounting point, and is set up to be raised into a steadily smaller V-shape. The guiding plates can be set up so that they, in the longitudinal direction, are, in the main, placed transverse to the longitudinal direction of said wire, chain, etc., whereby the end edges of the guiding plates lie against said wire, chain etc.

When the guiding plates are partially driven up, they are set up to guide said wire, chain, etc., between respective end edges. When the guiding plates are driven all the way up, they are set up to hold said wire, chain, etc., between the respective end edges. To hold a wire or the like, said end edges can be fitted with an insert, and the end edge of the guiding plate comprises, in this case, a groove arranged to receive said insert.

Each of the guiding plates is preferably connected to a pressure cylinder arranged to raise and lower the guiding plates. Furthermore, the guiding plates can be arranged in a box that is completely, or partially, sunk into the deck of the vessel, where the box can further comprise at least one pressure cylinder arranged to raise and lower the guiding plates. The box can also comprise a lower opening that is connected to a drainage system for removal of moisture that can come into the box.

The invention shall now be described in more detail with the help of the enclosed figures, in which.

Figure 8:
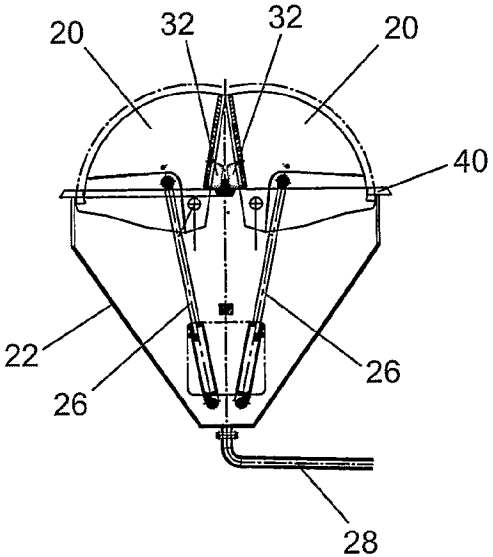
Figure 7:
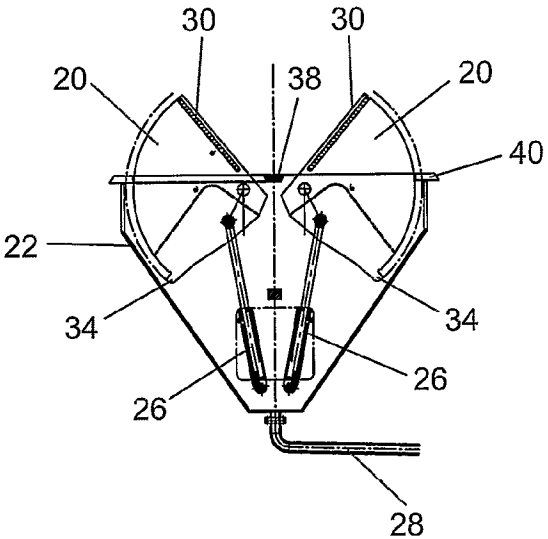
Figure 6:
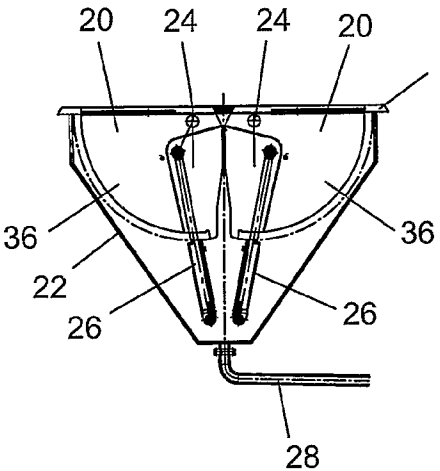

The FIGS. 6, 7 and 8 show the centring device according to the invention in different working positions.

Figure 1:
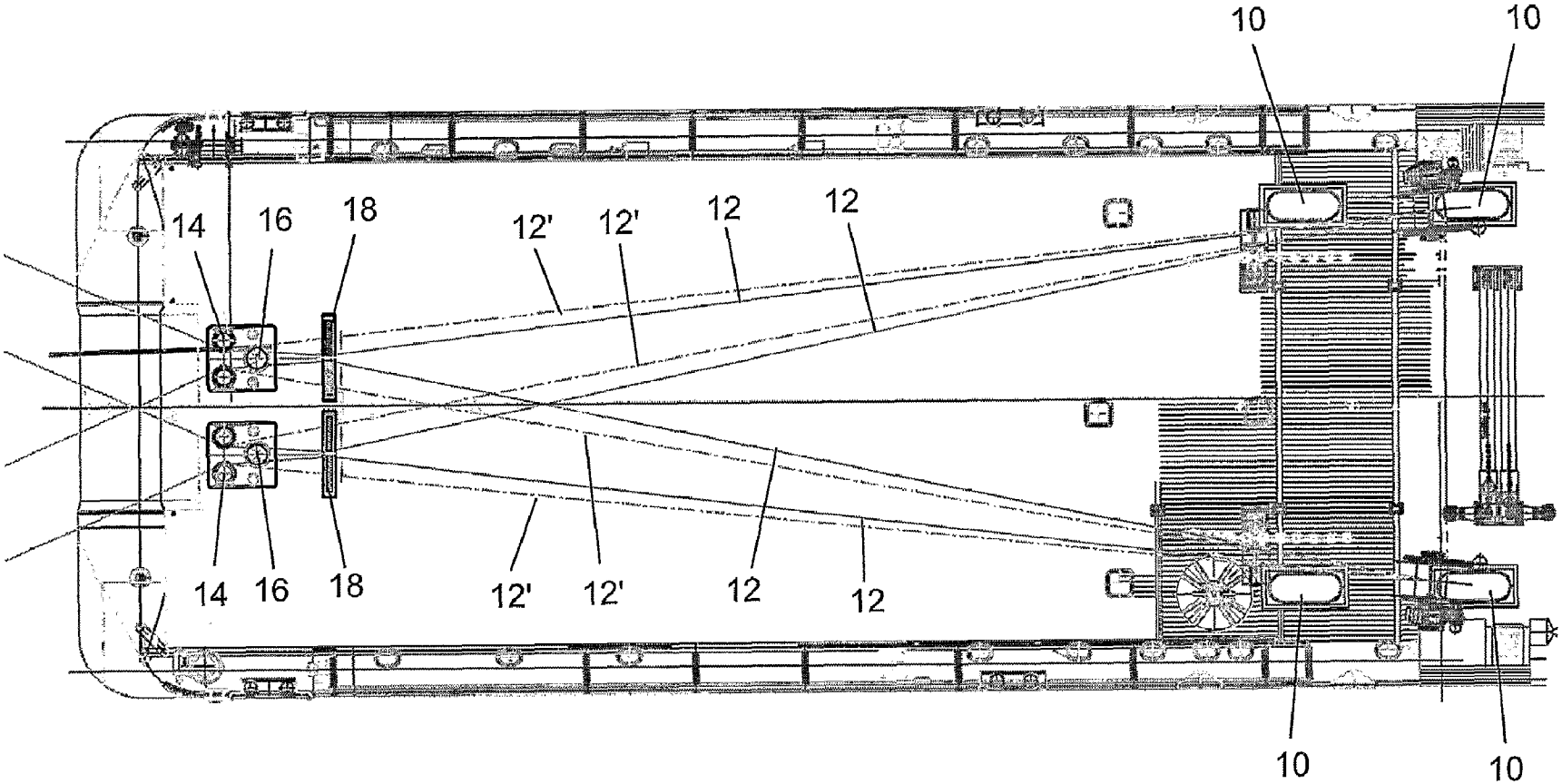
FIG. 1 shows the stern of the vessel encompassing the system according to the present invention.
Figure 2:
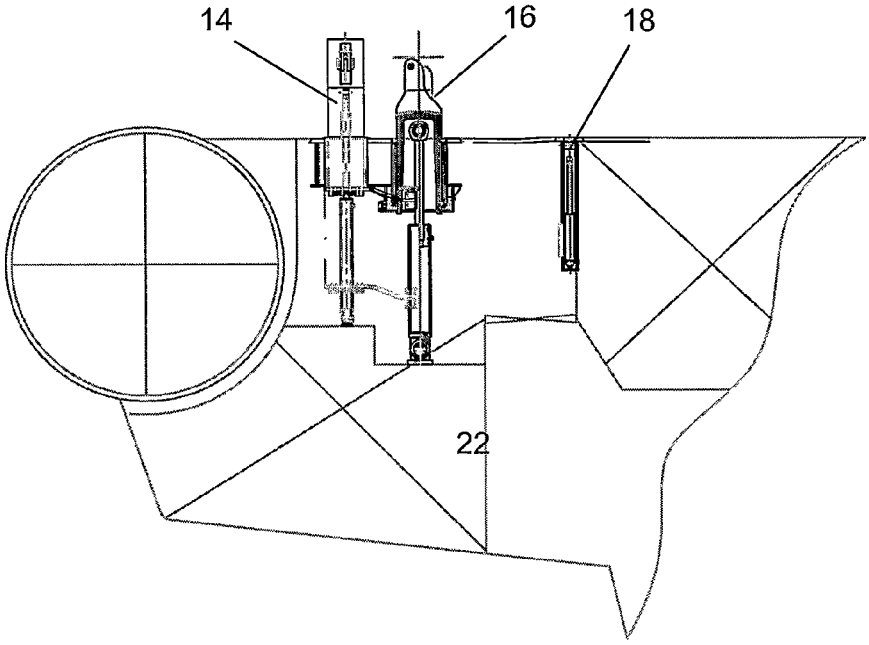
FIG. 2 shows a partial section of the stern of the vessel shown in FIG. 1.
Figure 3:
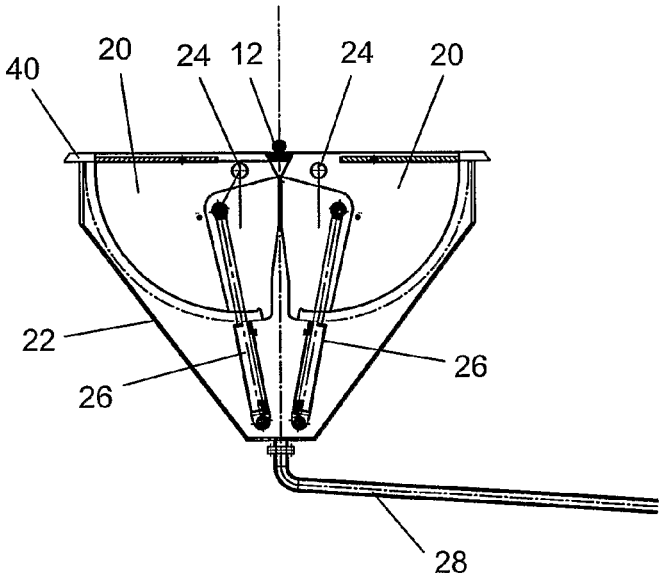
FIG. 3 shows a centring device according to the invention viewed from the side.
Figure 5:
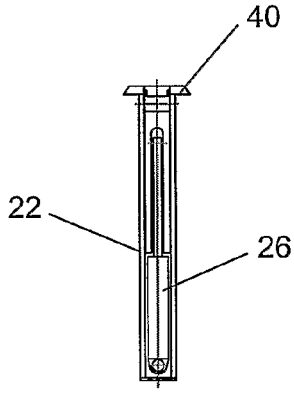
FIG. 5 shows the centring device shown in FIGS. 3 and 4 seen partially in cross section.
Figure 4:
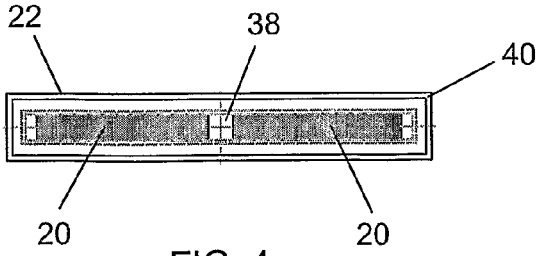
FIG. 4 shows the centring device shown in FIG. 3 viewed from above.

FIG. 1 shows, as mentioned, the stern of a ship, comprising the system according to the invention. On an anchor handling vessel, one or more winches 10 are normally mounted, such as tugger winches, to handle wire, chains, etc., shown by the reference number 12. Normally, one or more tow pins 14 and shark jaws 16 are also mounted adjoining the stern of the vessel. Different winch types, tow pins and shark jaws, and also other necessary equipment onboard an anchor handling boat or the like, are regarded to be known by one skilled in the arts and will therefore not be described further here. The full lines 12 represent wire, chain, etc., after being pulled in, while the dotted lines 12' represent wire, chain, etc., before they are pulled in. At least one centring device 18 is arranged between said tow pins 14, shark jaws 16 and winches 10, preferably adjoining said tow pins and shark jaws. In the example shown, two centring devices 18 are arranged.

The centring device 18 comprises at least two guiding plates 20 that can be raised and lowered and that are set up to guide and possibly to hold said wire, chain, etc. The guiding plates 20 are preferably arranged so that the end edges 30 of the plates turn toward the wire, chain, etc., in the longitudinal direction, i.e. that the guiding plates 20 are set up so that they are, in the longitudinal direction, in the main, transverse to said wire, chain, etc., in the longitudinal direction, and the guiding plates 20 are set up to rotate about their individual mounting point 24 so that the guiding plates go into a steadily smaller V-shape, as shown, for example, in FIG. 7. The end edges 30 of the guiding plates 20 are initially flat, so that when the guiding plates 20 are driven down, the end edges 30 are more or less level with the deck of the vessel. The rear side 36 of the guiding plates 20, i.e. the side that faces down when the guiding plates are driven down, in principle, can be of any shape. However, in the embodiment example shown, the rear side 36 of the guiding plates is formed with a partially circular form and can comprise a lip or stopper 34 to prevent the guiding plates 20 being driven up too far.

The guiding plates 20 are preferably arranged in a box 22 together with their individual pressure cylinder 26 such as, for example, a hydraulic cylinder. The one end of the pressure cylinder 26 is anchored in a lower part of the box 22, while the other end of the pressure cylinder is arranged to a rear part of the guiding plate, at a point which lies outside the mounting point 24, whereby the guiding plate 20 is forced to rotate about its mounting point 24 when the pressure cylinder 26 is operated. The pressure cylinders 26 can be driven separately from their own control appliance, for example, placed on the bridge of the vessel, or the pressure cylinders can be driven simultaneously from a common control appliance. It shall be mentioned that the control appliance(s) can of course be placed other places than on the bridge, for example, on the deck near the working area.

The guiding plates 20 are set up to guide said wire, chain, etc. 12 between the respective end edges 30 when they are partially driven up. The guiding plates can be driven up in a steadily smaller V-shape, as shown in FIG. 7, which thereafter goes into a reverse V-shape when the guiding plates are driven up completely, as shown in FIG. 8. When the guiding plates 20 are driven up completely, they are set up to hold said wire, chain, etc. 12 between respective end edges 30. If a wire is used, it is preferred to use an insert 32 mounted to the end edges 30 to clamp said wire as shown in FIG. 8. The end edges 30 of the guiding plate 20 preferably comprise a groove to receive said insert 32.

When a chain is used it is initially not necessary to use such an insert, but it may be that an insert can also be used for a chain if circumstances make it necessary.

Said box 22, in which the guiding plates 20 are arranged, can comprise a lower opening that is connected to a drainage system 28 for removal of moisture that may come into the box. Furthermore, in an upper part of the box 22, between the guiding plates 20, a small area 38 can be arranged on which said wire, chain, etc. can lie. This area 38 can be arranged separately or be part of a cover 40 that is mounted on the upper part of the box 22. The cover 40 comprises, of course, slots for the passage of the guiding plates 20.

The invention claimed is:

1. System for handling a wire, a chain or cable onboard a vessel, said system comprising:

a number of winches mounted on a deck of the vessel for pulling in and letting out said wire, chain or cable;

at least one tow pin and at least one shark jaw mounted in an area on the stern of the vessel, and arranged to guide or hold said wire, chain or cable that runs to or from said winches; and at least one centring device mounted in a housing which is located at a separate area of the deck between said tow pin and shark jaw, and said winches, the centring device including at least two guiding plates that can be raised and lowered, said guiding plates being rotatably mounted about mounting points arranged in the housing, said guiding plates having end edges configured to form a V-shape arrangement therebetween when the guiding plates are raised from the housing, and are completely or partially positioned within the housing when the guiding plates are lowered, wherein the V-shape arrangement between the guiding plates of the centring device operably guides said wire, chain or cable to said shark jaw, the guiding plates being arranged in a longitudinal direction substantially transverse to said wire, chain or cable, such that when the guiding plates are raised, the end edges of the guiding plates abut said wire, chain or cable to prevent rotation thereof, and wherein each guiding plate is connected to a separately driven pressure cylinder to raise and lower the guiding plates with respect to the housing.

2. The system according to claim 1, wherein the guiding plates, when they are partially driven up, are arranged to guide said wire, chain or cable between respective end edges.

3. The system according to claim 1, wherein the guiding plates, when they are completely driven up, are arranged to hold said wire, chain or cable between respective end edges.

4. The system according to claim 3, wherein said end edges are equipped with an insert to hold a wire chain or cable.

5. The system according to claim 4, wherein the end edge of the guiding plates comprises a groove arranged to receive said insert.

6. The system according to claim 2, wherein each of the guiding plates is connected to a pressure cylinder arranged to raise and lower the guiding plates.

7. The system according to claim 1, wherein the housing comprises a lower opening that is connected to a drainage system to remove moisture collected in in housing.

8. The system according to claim 1, wherein the housing is positioned at least partially beneath the deck of the vessel.

9. The system according to claim 1, wherein the guiding plates extend above the deck in a raised position and at least partially below the deck in a lowered position.

10. The system according to claim 1, wherein the guiding plates are substantially trapezoidal in shape.

11. The system according to claim 1, wherein the housing has a top portion positioned substantially level with the deck and the remaining portion of the housing is positioned below the deck.

* * * * *